US006729798B2

(12) United States Patent
Coe et al.

(10) Patent No.: US 6,729,798 B2
(45) Date of Patent: May 4, 2004

(54) FLOW DIVERTER SYSTEM AND METHOD

(75) Inventors: Thomas J. Coe, Stafford, VA (US); John O. Scherer, Dayton, MD (US)

(73) Assignee: Computer Sciences Corporation, El Segundo, CA (US)

( * ) Notice: Subject to any disclaimer, the term of this patent is extended or adjusted under 35 U.S.C. 154(b) by 0 days.

(21) Appl. No.: 10/105,958

(22) Filed: Mar. 21, 2002

(65) Prior Publication Data

US 2002/0168230 A1 Nov. 14, 2002

Related U.S. Application Data

(60) Provisional application No. 60/331,351, filed on Mar. 26, 2001.

(51) Int. Cl.[7] ..... E02B 15/00; E02B 15/04

(52) U.S. Cl. ..... 405/60; 405/63

(58) Field of Search ..... 405/60, 63, 64, 405/65, 67, 70, 71, 80; 114/243

(56) References Cited

U.S. PATENT DOCUMENTS

| | | | | |
|---|---|---|---|---|
| 1,397,891 A | | 11/1921 | Jones | |
| 3,638,430 A | * | 2/1972 | Smith | 405/66 |
| 3,651,647 A | * | 3/1972 | Flaviani | 405/71 |
| 3,686,870 A | * | 8/1972 | Blomberg | 405/70 |
| 4,136,994 A | | 1/1979 | Fuller | |
| 4,146,477 A | | 3/1979 | Challener | |
| 4,174,186 A | * | 11/1979 | Kasai et al. | 405/71 |
| 4,391,707 A | | 7/1983 | Gordon | |
| 4,425,053 A | * | 1/1984 | Muto et al. | 405/63 |
| 4,511,285 A | | 4/1985 | Eriksson | |
| 4,610,794 A | | 9/1986 | Tsahalis | |
| 4,661,013 A | | 4/1987 | Jenkins | |
| 4,700,651 A | * | 10/1987 | Hale | 114/243 |
| 5,727,902 A | | 3/1998 | Brown | |
| 6,488,445 B1 | | 12/2002 | Claeson et al. | |

FOREIGN PATENT DOCUMENTS

| | | | | |
|---|---|---|---|---|
| WO | WO 00/34589 | | 12/1999 | |
| WO | WO/0034589 | * | 6/2000 | E02B/15/04 |

OTHER PUBLICATIONS

Use of Floating Deflectors for Oil Spill Control in Fast Flowing Waters; N.E. Eryuzlu and R. Hausser; Mar. 8–10, 1977; pp. 335–340; 1977 Oil Spill Conference, New Orleans, La.

Columbia River Fast Water Tests; Kurt Hansen; Sep. 1999; pp. 9–15; U.S. Coast Guard Research and Development Center.

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; Jan. 14, 2000; CSC Defense Group Advanced Marine Center.

(List continued on next page.)

*Primary Examiner*—Heather Shackelford
*Assistant Examiner*—Lisa M. Saldano
(74) *Attorney, Agent, or Firm*—Meyertons, Hood, Kivlin, Kowert & Goetzel, P.C.; Eric B. Meyertons

(57) ABSTRACT

A flow-diverter apparatus includes two hull and foil assemblies pivotally connected by rigid members and attached to control lines. Several flow-diverter apparatus may be joined by lines, cables or rigid links to form a flow-diverter system. The apparatus may also include lines/cables to vertically distribute control line force. Attachment points or lines for booms, scientific equipment, dispersion equipment, fire suppression equipment or other devices may also be provided. Apparatus may use horizontal hydrodynamic lift forces to create a diversion flow transverse to an onset flow, to deploy and hold equipment transverse to an onset flow, and/or to provide mixing on the surface of a body of water. Apparatus may be deployed from shore, from a fixed point in the water, or by a vessel.

66 Claims, 9 Drawing Sheets

OTHER PUBLICATIONS

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; Feb. 2, 2000; CSC Defense Group Advanced Marine Center.

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; Mar. 2, 2000; CSC Defense Group Advanced Marine Center.

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; Apr. 12, 2000; CSC Defense Group Advanced Marine Center.

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; May 4, 2000; CSC Defense Group Advanced Marine Center.

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; Jun. 2, 2000; CSC Defense Group Advanced Marine Center.

Monthly Progress, Status and Management Report Contract No. DTCG39–00–C–R00003 Oil Spill Containment (Flow Diverters) and Contract No. DTCG39–00–C–R00005 Oil Spill Containment (Sorbent Recovery); Thomas J Coe; Jul. 13, 2000; CSC Defense Group Advanced Marine Center.

Coe, Thomas and Brian Gurr. "Control of Oil Spills in Fast Water Currents, A Technology Assessment," USCG Research and Development Center, Avery Point, Groton, CT, Report No. CG–D–18–99, Government Accession No. ADA 369279, submitted to US Coast Guard on Dec. 1998, Final Report published May 1999.

Coe, Thomas. "Control of Oil Spills in High Speed Currents, A Technology Assessment," International Oil Spill Conference, Seattle, Washington, Mar. 1999.

Coe, Thomas. "Control of Oil Spills in High Speed Currents, A Technology Assessment," Presentation slides for presentation given at International Oil Spill Conference, Seattle, Washington, Mar. 1999.

International Search Report; PCT/US02/09493, Date of mailing: Dec. 18, 2002.

Coe, Thomas, "Oil Spill Flow~Diverter User Manual" CSC Advanced Marine 1725 Jefferson Davis Highway, Suite 1300, Arlington, VA, USCG Contract DTCG39–00–C–R00003, submitted to US Coast Guard Jul. 2000.

Coe, Thomas, "Oil Spill Response in Fast Currents—A Field Guide," CSC Advanced Marine, draft final report submitted to US Coast Guard Sep. 1999.

"Oil Spill Response in Fast Currents—A Field Guide," US Coast Guard Publication; Oct. 2001.

Blomberg, "Advanced High–Speed Oil Combating Technique" correspondence, Nov. 9, 1997 (rough, web–site generated translation attached).

Blomberg, "Symmetrical Wing–Profiled Rudder With Adjustable Flaps for Deployment of Oilbooms at Sea and in Rivers" correspondence, Sep. 10, 1997.

Blomberg, "Contingency Planning and Oil Spill Response Technique for Rivers with Strong Current and Intense Rive Vessel Traffic" Blomberg Offshore AB correspondence, 1995–1996.

Blomberg, "Tests and Trials", Blomberg Offshore AB, Dec. 7, 1996.

* cited by examiner

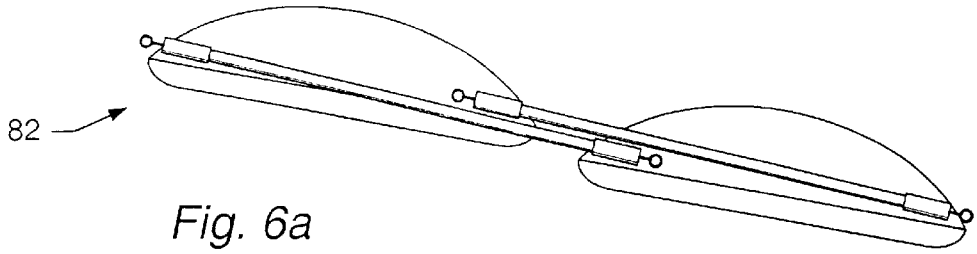
Fig. 6a
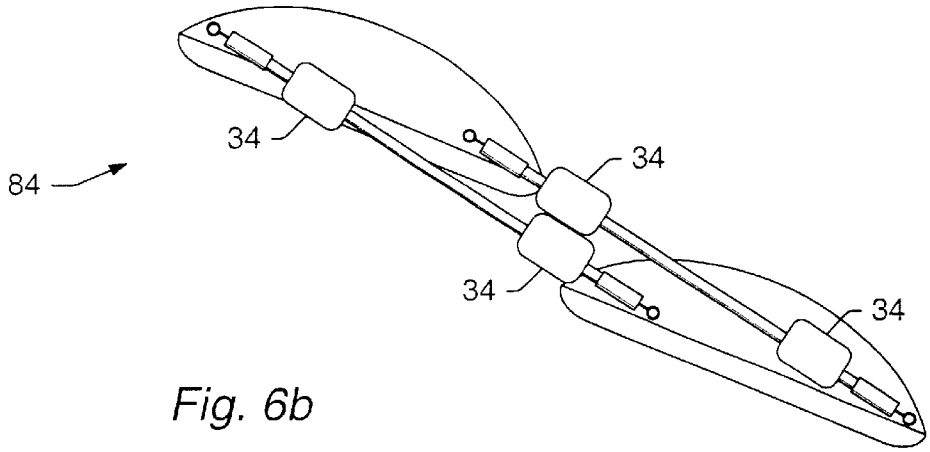
Fig. 6b
Fig. 6c
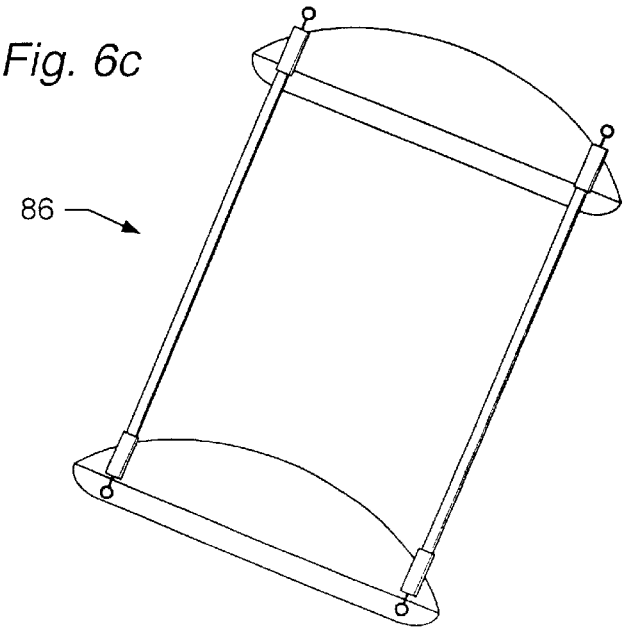

FLOW DIVERTER SYSTEM AND METHOD

PRIORITY CLAIM

This application claims the benefit of the U.S. Provisional Patent Application Serial No. 60/331,351 entitled "Flow Diverter System and Method," to Thomas J. Coe and John O. Sherer and filed Mar. 26, 2001, and to the U.S. Provisional Patent Application entitled "Flow Diverter System and Method," to Thomas J. Coe and John O. Sherer and filed Feb. 14, 2002.

STATEMENT REGARDING FEDERALLY SPONSORED RESEARCH OR DEVELOPMENT

This invention was made with Government support under Contract #DTCG39-00-C-R00003 entitled "Oil Spill Containment and Cleanup," awarded by the U.S. Coast Guard Research and Development Center. The Government has certain rights to this invention.

BACKGROUND OF THE INVENTION

1. Field of the Invention

The present invention relates to an apparatus and method for diverting the surface flow of a body of water.

2. Description of the Relevant Art

Annually, about 645 million tons of oil are transported on United States waterways in areas where currents routinely exceed one knot. In addition, thousands of facilities located on the banks of fast-current waterways store millions of gallons of oil. Additionally, thousands of oil pipelines traverse fast-water rivers, and bays, also posing oil spill threats. Between 1992 and 1998, about fifty-eight percent of all oil spilled in the U.S. was spilled in fast-current waterways. This figure represents about 4.5 million gallons of oil spilled in swift flowing rivers, harbors, bays and coastal areas where conventional boom and skimmers may be ineffective.

Containment and removal of oil and other floating contaminants spilled in inland rivers and coastal tidal regions where currents exceed one knot may be very difficult because many skimmers and conventional booming methods may not be effective in fast currents. When skimmers or booms are used in currents that exceed about one knot, contaminants may be entrained in the water flow and follow the water path under the boom or skimmer. Containment and removal of floating contaminants in currents exceeding one knot may be accomplished using specialized equipment and tactics; however, properly trained response personnel may be essential for ultimate success. Tactics to contain and remove contaminants in currents over one knot may include: skimming the contaminants off of the surface as they go by a recovery device; slowing the current down without causing entrainment of the contaminants, then skimming the contaminants off of the surface; or redirecting the contaminant with a diversion device to an area where the current is slower and effecting the recovery there. Benefit may also be derived by diverting contaminants away from sensitive areas and by concentrating them for recover or other remediation methods.

Fast water may create large drag forces on vessels and equipment making them difficult to anchor and maneuver, and may often cause equipment failure (e.g., submergence, planing, or breakage). Maneuvering vessels and equipment in fast water may be dangerous to both personnel and equipment. Fast water may also accelerate many spill processes necessitating quicker and more efficient responses compared to stagnant water or slow moving current conditions. Timely response efforts may be required in order to minimize environmental damage, economic losses and associated cleanup costs A Boom Vane was developed to deploy a deflection boom from shore without the need of a boat or mid channel anchor. The device includes a series of paravanes fixed to a frame with a surface float rudder, one main tension line, a bridle and a control line. The device uses hydrodynamic forces to pull the Boom Vane and an attached deflection boom out into a current. The Boom Vane is positioned in the water at an equilibrium point where hydrodynamic lift is balanced by the main tension line and the boom drag. The rudder controlled by a line allows retrieval of the system.

Another spill clean up system is a floating deflector system. The floating deflector system includes a series of large (approximately 16.4 feet high by 34 feet long) independent parallel foils spaced about 34 feet apart using cables or lines. The deflectors were designed to divert a potential oil spill from upstream oil processing facilities from a fast moving portion of a river, to a slow moving portion of the river. The deflector system was designed to be deployed from a fixed location on the shore. Each deflector was designed to have a submergence depth between ⅓ and ½ the mean water depth.

SUMMARY OF THE INVENTION

An embodiment of a flow-diverter disclosed herein may be composed of two foil assemblies. At least one of the foil assemblies may include a buoyant member (or "hull"). At least one of the foil assemblies may include a hydrofoil (or "foil") that extends at least partially into the water. In certain embodiments, both foil assemblies may include a buoyant member and a foil. A foil may extend from the bottom, side, top, or an end of the hull and extend into the water. The foil assemblies may be connected in a "catamaran" configuration by one or more cross members above the water. Additionally, none, one or more cross members may be connected to the bottom of the foils. At least one of the cross members, usually above the water, may be rigid to keep the foil assemblies separated. The foils may float approximately vertically in the water in a catamaran configuration. The cross members may be free to pivot about a vertical axis at their attachment to the hulls and foils. Thus, each foil assembly of a catamaran may be free to move relative to the other foil assembly but remain parallel to each other. The catamaran hulls may be linked with neighboring catamaran hull pairs by cables, lines, or rigid links attached to the ends of the cross members to form a string of diverter catamarans. These catamaran connection lines/cables/links may generally be the same length as the cross members. The most inboard foil assembly of a catamaran or string of catamarans may be connected to shore, a support vessel, or a fixed structure in the water with one or more control lines. Each control line may be bridled to the upper and lower ends of the cross members to prevent the catamaran from rolling due to the lateral loads on the foil assemblies and to distribute loads evenly between the hulls and foils. The bridle arms may be adjustable using short sections of chain, shackles or other such means at the bridle apex. In a current or when pulled through a body of water, the angle of attack of the catamaran or string of catamarans may be controlled by adjusting the length of a first control line relative to a second control line. The foils and hulls may thus form a cascade that generates a lateral force with a magnitude dependant upon the foil and hull shape and the angle of attack of the foil assemblies to the oncoming flow. This lateral force (or "lift")

may move the catamaran or string of catamarans out into the current where they may reach a steady state position when lift and drag of the system, balanced against control line tension are equal. The foil assemblies may create a lateral force and may present a physical barrier that deflects the surface flow at an angle close to the cord lines of the foils and lateral to the onset flow. This diversion current may thus transport floating contaminants in a direction toward the mooring control line side downstream, lateral to the onset flow. The catamaran or catamarans may also be quickly retrieved back to a deployment point by either reversing the angle of attack, or increasing the angle of attack until the foil is stalled.

An advantage of embodiments disclosed herein may be that due to their small size, they may be deployable from a vessel or from shore, by one or two people. Additionally, small size may allow a catamaran, or catamarans to be transported easily and deployed quickly.

Another advantage may be that the catamaran configuration may provide substantial roll stability, while allowing catamarans in a string of catamarans to adjust to waves or other surface flow effects individually. This roll stability may prevent planing or submergence of the foils due to uneven control line forces, uneven bridle line forces, or environmental forces (e.g., wind and current) on the catamaran(s).

Another advantage of the embodiments disclosed herein may be that a number of catamarans may be effectively strung together to form a string of catamarans. This expandability may increase the flexibility and sweep effectiveness of the system.

Yet another advantage may be that the catamaran configuration, which is collapsible, may facilitate deployment, retrieval, storage and transportation of the system.

BRIEF DESCRIPTION OF THE DRAWINGS

Other objects and advantages of the invention will become apparent upon reading the following detailed description and upon reference to the accompanying drawings in which:

FIGS. 6*a,* 6*b,* and 6*c* depicts several positional modes of a flow diverter catamaran;

FIG. 8*b* depicts a schematic side view of an embodiment of a foil assembly corresponding to the embodiment depicted in FIG. 8*a.

Figure 1:
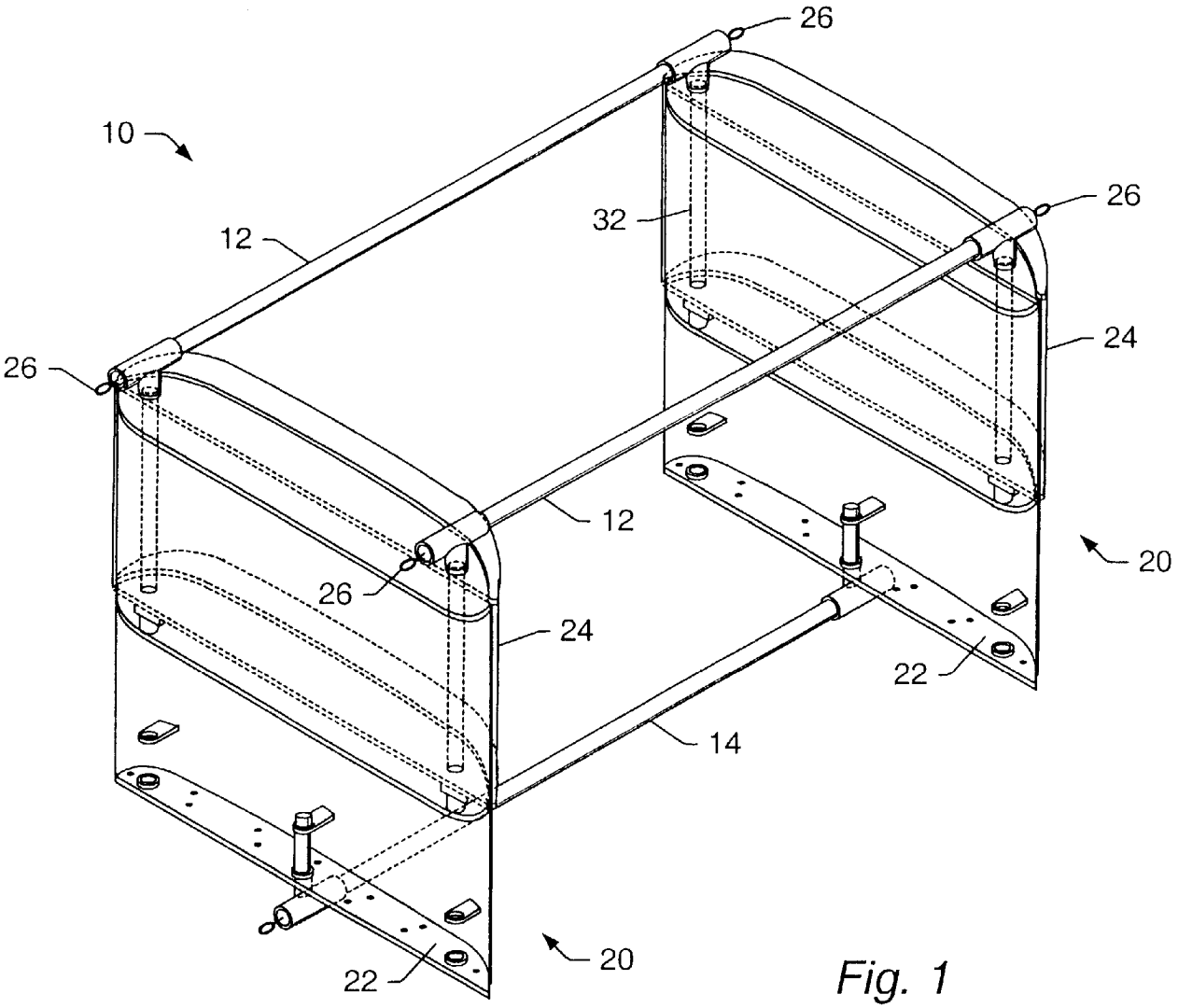
FIG. 1 depicts a schematic perspective view of an embodiment of a flow-diverter catamaran.

While the invention is susceptible to various modifications and alternative forms, specific embodiments thereof are shown by way of example in the drawing and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims.

DETAILED DESCRIPTION OF THE PREFERRED EMBODIMENTS

Referring to FIG. 1, a flow-diverter catamaran is generally referenced by numeral 10. Flow-diverter catamaran 10 may include two foil assemblies 20, connected to two elongated rigid cross members 12. Each foil assembly 20 may include a hull 24, and at least one foil 22 configured to extend into a body of water. A "foil" may be defined as a projection that alters the surface flow of water moving in relation to the projection. The foil or foils may be integral to the hull or separately attached. The foil assemblies may be connected in a catamaran configuration by one or more cross members above the water. Additionally, none, one or more cross members may be connected to the bottom of the foils. At least one of the cross members, usually above the water, may be rigid to keep the foil assemblies separated. As used herein, a "catamaran" may generally refer to at least two foil assemblies connected in such a manner. It is believed that the catamaran design may provide roll stability to keep the foil assemblies 20 substantially vertical in the water. As used herein, a "body of water" may include, but is not limited to: a lake, bay, ocean, stream, river, inlet, creek, channel, canal, etc. As used herein, a "surface flow" may refer to motion of the water relative to the apparatus. Surface flow may include, but is not limited to, motion caused by towing the apparatus behind a vessel, or motion caused by the presence of a current in a body of water. Maintaining the foil assemblies in a substantially vertical orientation in the water may prevent submergence or planing of catamaran 10 due to the residual lift force created when a roll angle is induced by waves or uneven control line forces. This may ensure that foil assemblies 20 provide maximum flow diversion. A flow diverter system, reference numeral 50 in FIG. 2, may include one or more catamarans 10, wherein individual catamarans 10 may be connected by lines 16.

Figure 8A:
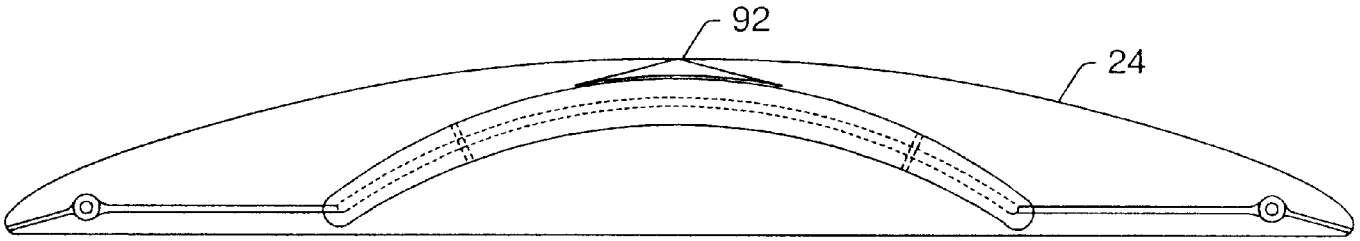
FIG. 8*a* depicts a schematic plan view of an embodiment of a foil assembly.
Figure 8B:
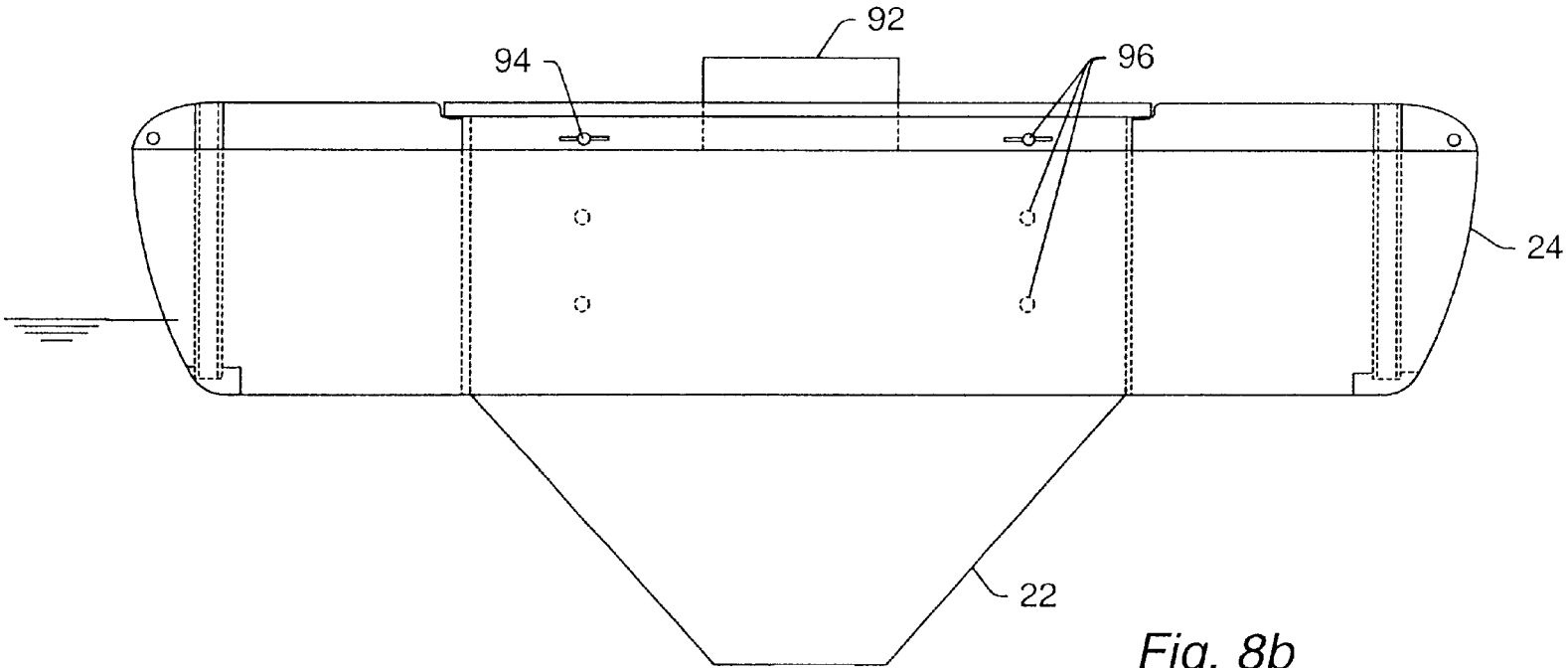

In an embodiment, hulls 24 may include a top flotation section that is symmetrical fore and aft. This symmetry may allow either end to serve as the bow. Hulls 24 may be configured to follow the curved streamlines and supplement the force generated by foils 22. The flotation volume and shape of hulls 24 may be sufficient to provide freeboard and reserve buoyancy to support foils 22. The shape of hulls 24 may also help to maintain fairly level trim and heel angles in current and wave heights up to the design values. In an embodiment, hulls 24 may be well faired with a smooth bow and stern to minimize turbulence. It is believed that a smooth bow and stem may minimize contaminant mixing with the water. In an embodiment, hulls 24 may be filled with a buoyant solid, such as closed cell foam. It is believed that filling hulls 24 with a buoyant solid may add strength and preserve buoyancy if the outer skin is damaged. Hulls 24 may be constructed of a material, or coated with a material, which resists oil intrusion, chemical degradation and denting from handling abuse or collisions with floating debris. For example, hulls 24 may be constructed of closed cell foam. In such a case, the closed-cell foam material may be coated to improve its durability (e.g., with a fiberglass cloth and/or epoxy material). Hulls 24, elongated rigid cross members 12, and other portions of flow diverter system 50 that may remain above water during use (e.g., control lines, bridles, attachment points, spacers, etc.) may be constructed of fire-resistant materials. Such an embodiment may allow diversion and consolidation of oil for in-situ burning or diversion of burning oil or other floating or emerging combustible or burning material. For high current use, hulls 24 may be elongated (as depicted in FIG. 8). It is believed that elongated hulls 24 may provide for increased stability of catamaran 10 as well as decreased drag and turbulence.

Figure 2:
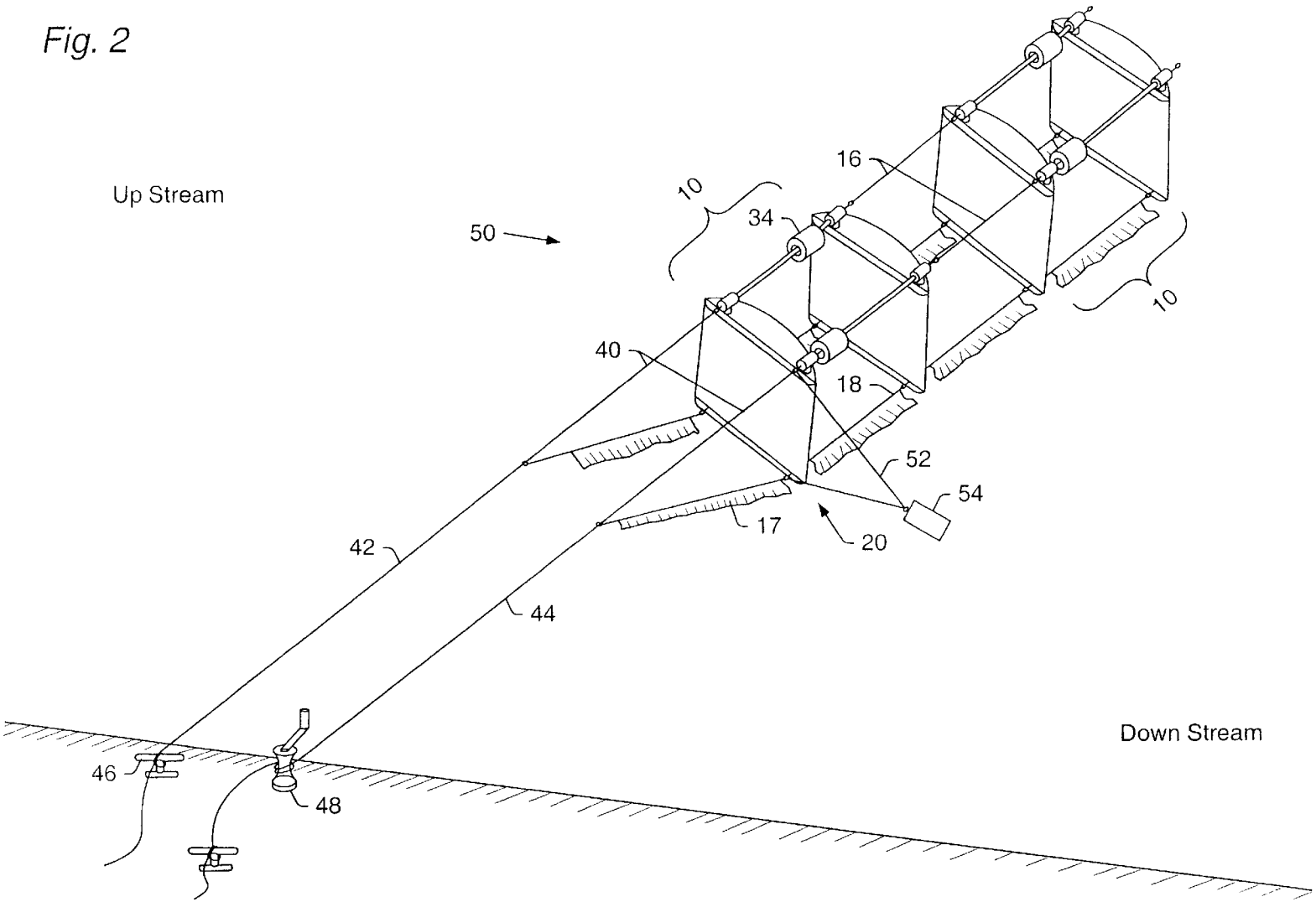
FIG. 2 depicts a schematic perspective view of an embodiment of a flow-diverter system.

Foils 22 may be flat or curved. In an embodiment, foils 22 may be curved to create a greater lateral force against the flow while minimizing turbulence. Foils 22 may have a length less than or equal to the length of hulls 24. Foils 22 may be symmetric fore and aft in profile and plan view so that either edge may serve as the leading edge. In an embodiment, foil 22 may have a cross section with a fair leading edge to maximize the attainable "lift" and minimize turbulence, thus minimizing contaminant mixing. Ballast material may be added to foils 22. The ballast material may be attached to foils 22, or internal to foils 22. It is believed that ballast material may help catamaran 10 to attain proper heel stability. Foils 22 may have either an open foil design (as depicted in FIG. 1), or an enclosed foil design (as depicted in FIG. 2). In an embodiment where foils 22 have an open foil design, the hull shape may have a cord depth twice that of the open foil. Such an embodiment may ensure that hydrodynamic lift forces are evenly distributed. Such an embodiment may reduce turbulence at the junction of the hull and foil. In an embodiment of an enclosed foil design, the submerged hollow sections of the foils may be filled with a solid to increase the strength of the foils. The foil and/or hull may have inclined leading and trailing edges (as depicted in FIG. 8). Such an embodiment may allow debris to easily deflect under the hulls/foils without building up on the apparatus causing undesirable drag and/or blockage of oil or other surface contaminant flow through the diverter system. In an embodiment, foils 22 may be constructed of a material, or coated with a material, which resists oil intrusion, chemical degradation and denting from handling abuse or collisions with debris. For example, foils 22 may be formed of aluminum plate. Additionally, in some embodiments, foils 22 may include one or more end caps. In such embodiments, the end caps may provide increased rigidity to foils 22 and reinforce openings used for coupling elongated members 32 to foils 22.

Rigid cross members 12 may connect foil assemblies 20 in pairs in a catamaran configuration. In some embodiments, a submerged cross member 14 below foils 22 may also connect foil assemblies 20. Submerged cross member 14 may be a rigid or flexible member. Submerged cross member 14 may be a low-diameter rigid member, cable, or a thin line. In some embodiments, foil assemblies 20 may be connected by two submerged cross members 18 (as depicted in FIG. 2) below foils 22. Submerged cross members 18 may be rigid or flexible members. Submerged cross members 18 may be low-diameter cables, or thin lines. Flexible fairings 17 may be coupled over submerged cross members 18. Fairings 17 may have a profile selected to minimize drag in a current of water. Thus, fairings 17 coupled to submerged cross members 18, may reduce drag of submerged cross members 18. Flexible fairings may also be coupled to cables 40 and control lines 42 and 44 to reduce the drag of these components. Rigid cross members 12, and submerged cross members 14 and 18 may be generally referred to as cross members. Cross members may be retained in place with a pin, snap ring, threaded connector, or other suitable device to prevent removal during operations while allowing the cross members to rotate freely about a vertical axis to foil assemblies 20. Thus, each foil assembly 20 of catamaran 10 may be free to move relative to the other foil assembly, but may remain parallel to the other foil assembly. The ends of each cross member may include an attachment point 26 (e.g., eyebolts, pad eyes, etc.). Attachment points 26 may be used to link a catamaran 10 with neighboring catamarans by use of lines 16 to form a string of catamarans. Lines 16 may be cables, rigid links allowed to pivot at attachment points, low-stretch lines or other such lines. Attachment points 26 may also be used to connect control line leads, control lines 42 and 44, or cables 40 to catamaran 10. In an embodiment, cross members may be attached to elongated members 32 coupled to foil assemblies 20. Elongated members 32 may allow the cross members to rotate freely on a vertical axis to the foil assemblies 20. Attachment points 26 may be coupled to elongated members 32 rather than to the ends of the cross members. Cross members, attachment points 26 or elongated members 32 may be configured to function as handles or lift points. Cross members may be easily removable for repair or replacement for ease of storage and shipment of major catamaran components.

Figure 9:
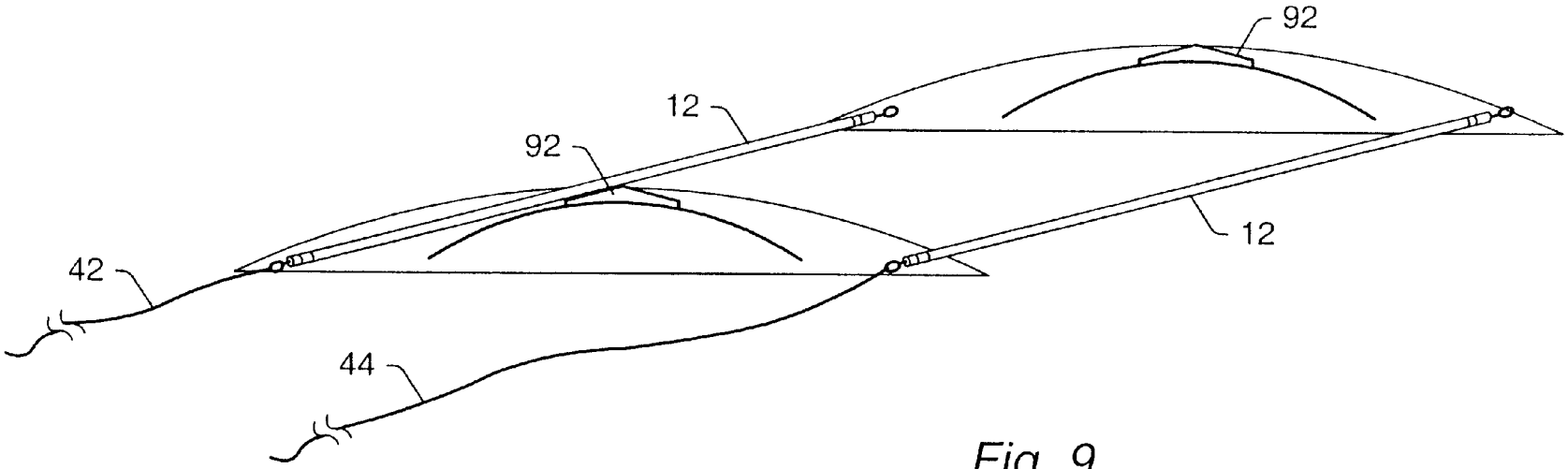
* and FIG. 9 depicts a schematic perspective view of an embodiment of a flow-diverter system.

As illustrated in FIGS. 6*a,* 6*b,* and 6*c,* the position of foil assemblies 20 of a catamaran 10 may be generally described as closed 84, collapsed 82 or open 86. Catamaran 10 may be described as collapsed 82 when the cord lines of the foil assemblies are aligned or nearly aligned as depicted in FIG. 6*a.* Conversely, in an open catamaran 86, the cord lines of the foil assemblies may be substantially parallel and separated by a distance determined by the catamaran design and current conditions. In an embodiment, spacers 34 may be provided on rigid cross members 12 to keep catamaran 10 from collapsing completely during use. In an embodiment, closed catamaran 84 may be configured to allow sufficient flow between foil assemblies 20 and sufficient differential forces to be exerted through control lines 42 and 44 to open catamaran 84 even when deployed in a slow current. In an embodiment, foil assemblies 20 may be configured to prevent the catamaran from collapsing during use by providing standouts 92 on hull 24 as depicted in FIG. 9. The standouts may inhibit the hulls from attaining a collapsed configuration. In an embodiment, spacers or other foil assembly configurations that keep catamaran 10 from collapsing may afford proper hull separation to open catamaran 10 in slow currents in either closed mode, that is, regardless of which edge of foil assemblies 20 is the leading edge.

In an embodiment, the spacing between foil assemblies 20 of a catamaran 10 may be larger than the hull length. In an embodiment, foil spacing may be about 1.3 or more times the hull length. It is believed that such an arrangement may minimize wave interference between hulls 24, and allow floating material on the water to pass unobstructed between foil assemblies 20 and be deflected down-stream as desired. This spacing and pivot design may allow the catamaran to be collapsed 82 to facilitate operations at high speed with reduced drag. Collapsing the catamaran may also facilitate lifting and storage of catamaran 10.

Figure 3:
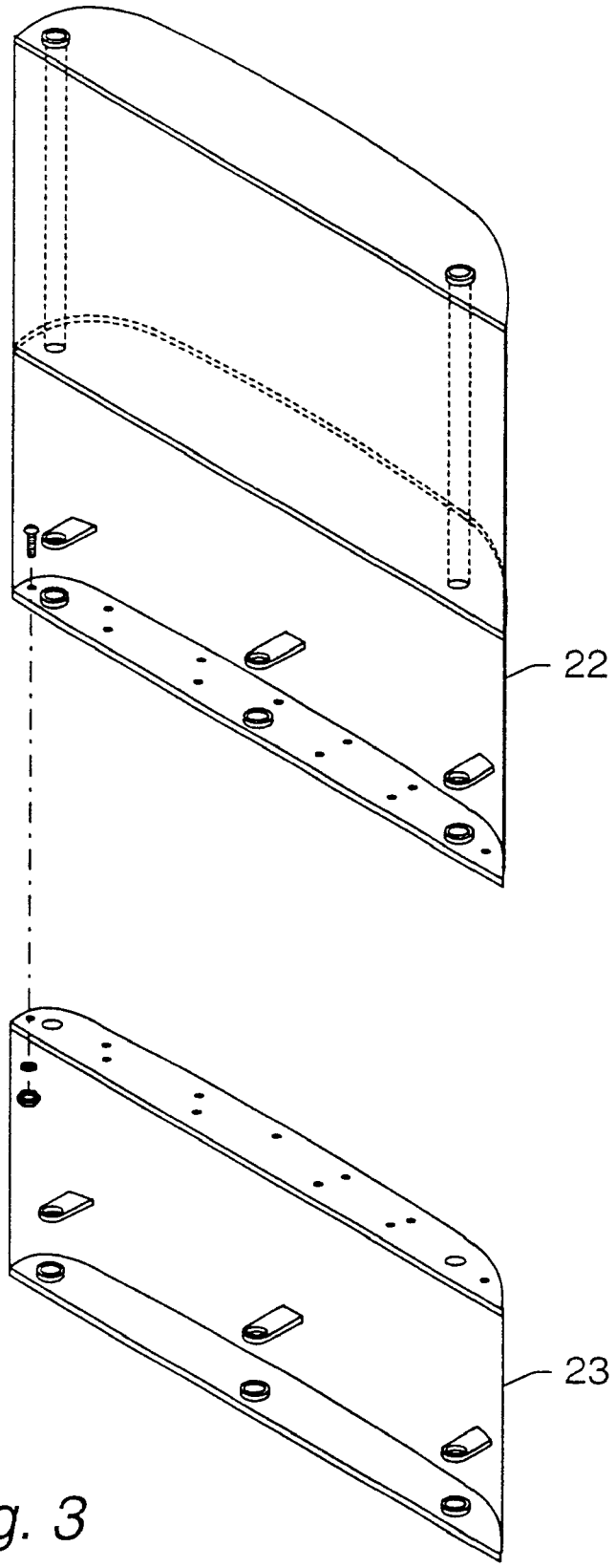
FIG. 3 depicts a cutaway schematic perspective view of an embodiment of a foil and foil extension.

In an embodiment, the draft of foil 22 may be extendable by adding foil extension 23 onto the bottom of foil 22, as depicted in FIG. 3. Foil extension 23 may allow the foil assembly to be customized in the field for the environmental conditions present at the time of use. For example, it is believed that a deeper draft of the foil may divert the flow further down stream. In another embodiment, the draft of the foil may be adjustable by sliding foil 22 in relation to the hull 24, as depicted in FIG. 8. The draft of foil 22 in FIG. 8 may be adjusted by moving foil 22 to a desired draft then securing foil 22 at that draft. For example, foil 22 may be secured at a desire draft by placing a pin, threaded connector, or other retaining device 94 through one or more of holes 96 in hull 24 and foil 22.

Figure 5:
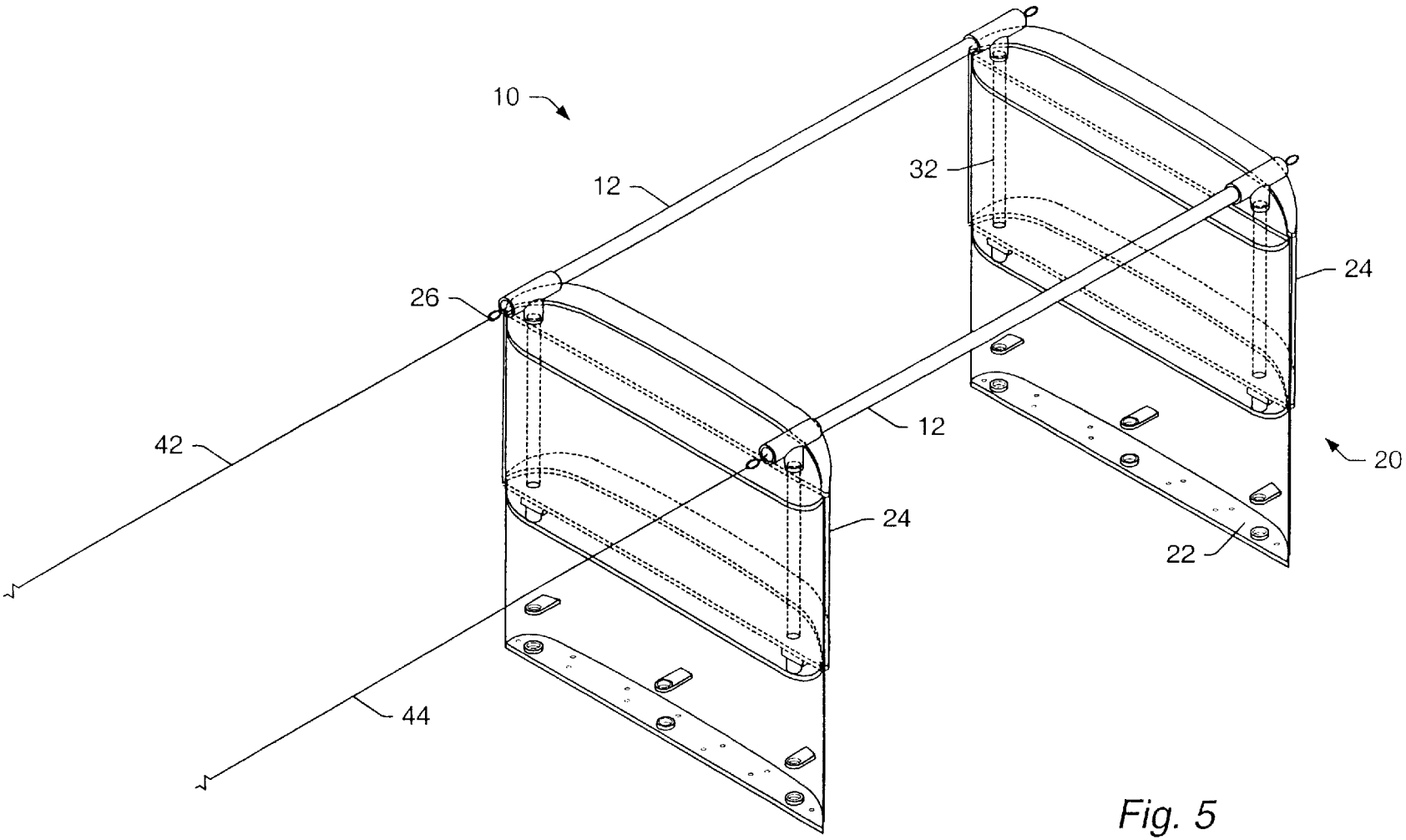
FIG. 5 depicts a schematic perspective view of an embodiment of a flow-diverter catamaran.

To enable a user to control one or more catamarans 10, control lines 42 and 44 may be provided, as depicted in FIG. 2. In general, controls lines 42 and 44 may allow a user to adjust the angle of attack of foil assemblies 20 with respect to the flow; thereby increasing or decreasing the "lift" generated by foils 22. Control lines 42 and 44 may be coupled to catamaran 10 in a variety of ways. The configuration of control lines 42 and 44 may vary according to the configuration of catamaran 10. Control lines 42 and 44 may be directly coupled to catamaran 10 at attachment points 26, as depicted in FIG. 5. Alternately, control lines 42 and 44 may be coupled to a control line lead that is coupled to catamaran 10. In another embodiment, control lines 42 and 44 may be attached to bridles 40, as depicted in FIG. 2. Bridles 40 may allow a user to adjust the angle of attack of foil assemblies 20, while distributing the force applied by control lines 42 and 44 between the top and bottom of foil assembly 20. It is believed that distributing the control force may prevent the foil assemblies 20 from tending to roll with the control force. The length of one arm of each bridle 40 may be adjustable. An adjustable length may allow a user to adjust bridle 40 to account for control lines 42 and 44 having an angle with respect to the water surface due to system 50 being deployed from a point elevated from the water surface. For example, if system 50 is deployed from a pier, or tall vessel, control lines 42 and 44 may have a steep angle with respect to the water surface. This angle may produce a control force with a substantial roll component. By adjusting the length of an arm of bridle 40, a roll component of force may be vertically distributed so that catamaran 10 does not have a tendency to roll.

The magnitude of forces generated by one or more catamarans 10 may be too large for an individual user to control without mechanical assistance. For this reason, control lines 42 and 44 may be coupled to a vessel, to shore, or to a fixed object in the water by moorings. In an embodiment, the upstream control line 42 may be secured. Control line 42 may be secured to a securing device 46 as may be available at the point of use. In such an embodiment, the down stream control line 44, may be movably secured. For example, downstream control line 44 may be movably secured by a winch 48, a pulley system, or other such movable securing device as may be available at the point of use. Such an arrangement may allow downstream control line 44 to be used to adjust the angle of attack of foil assemblies 20. In other embodiments, upstream control line 42 may be used to control the angle of attack, or both control lines may be secured.

Figure 7:
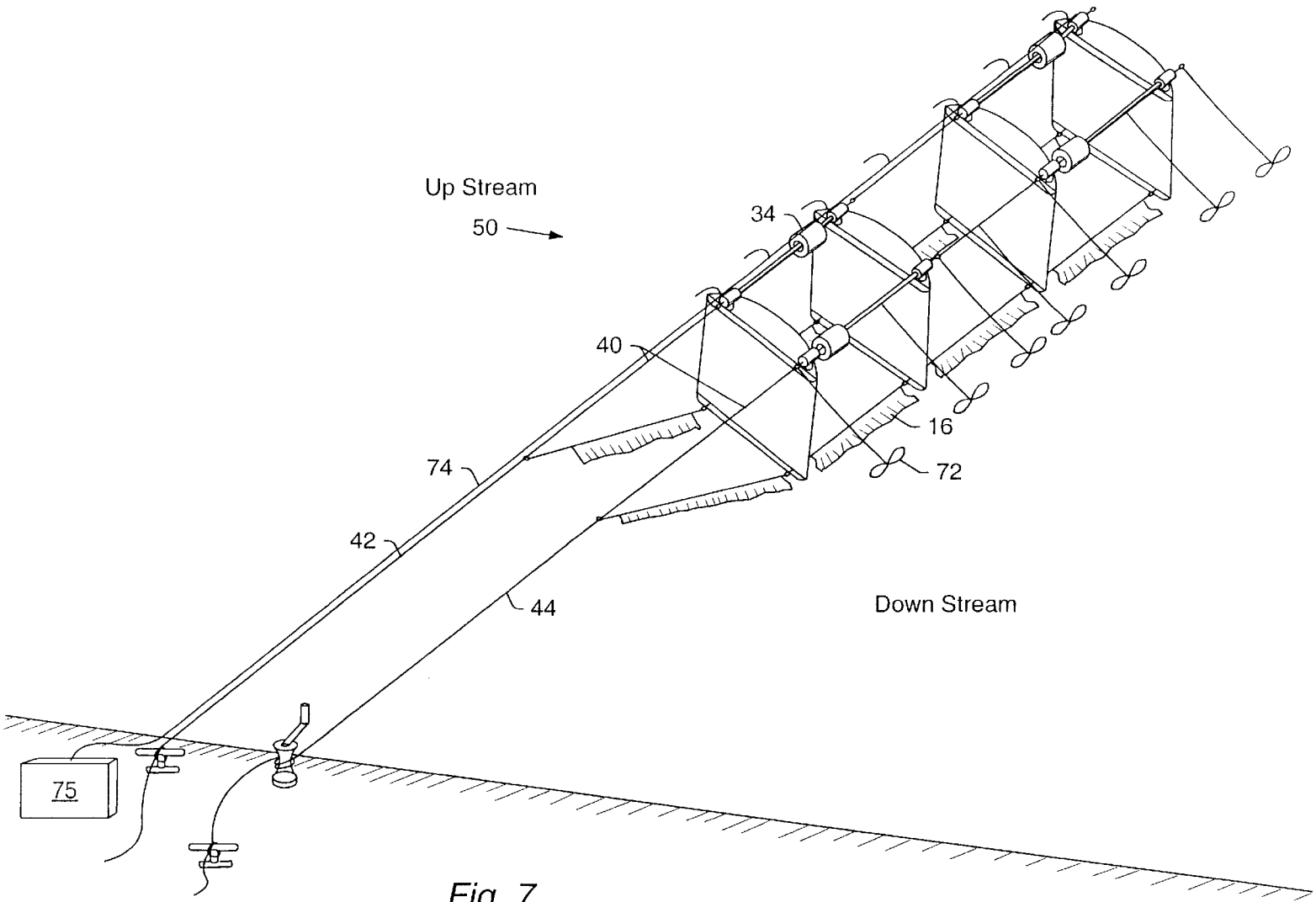
FIG. 7 depicts a schematic perspective view of an embodiment of a flow-diverter system.

Catamaran 10 may be configured to tow a boom, scientific instruments, mixing equipment, or other devices as depicted in FIG. 2. Devices 54 to be towed may be attached to cables 40, foil assemblies 20, control lines 42 and 44, or cross members 12, 14, 16, or 18. Devices 54 towed by system 50 may induce a drag force on system 50. If the drag force is large, it may cause catamaran 10 to have an undesirable pitch angle. Various arrangements may be used to minimize the impact of drag forces on system 50. For lightweight, low drag devices, it may be sufficient to tie the device to an appropriate portion of the system 50. For example, in an embodiment, floating impellers 72 may be connected to rigid cross members 12 by a line as depicted in FIG. 7. Such an embodiment may be useful for mixing a surfactant, or contaminant into the water. For heavier, or high drag devices, a towing cable 52 may be used, as depicted in FIG. 2. Towing cable 52 may distribute drag forces associated with the towed device vertically across one or more foil assemblies 20. By distributing the drag force, foil assembly 20 may be maintained at a stable pitch angle.

Drag forces may also be associated with submerged members of catamaran 10, lines 16 coupling two or more catamarans together, cables 40, or control lines 42 and 44. To minimize the impact of such drag forces, fairings 17 may be placed over one or more submerged members. In an embodiment, flexible zipper fairings may be used. It is believed that fairings 17 may reduce drag forces as well as minimize turbulence associated with submerged members.

During use flow diverter system 50, may passively "fly" out into a current from the point of deployment as depicted in FIG. 2. Control lines 42 and 44 may be used to adjust the angle of attack of foil assemblies 20 with respect to the current. Generally, the downstream control line may be used to adjust the angle of attack since it may have lower tension forces on it. Hydrodynamic forces created by system 50 may then pull the system away from the deployment point. When fully deployed, system 50 may generally reach a steady-state position at an angle downstream from the deployment point. The optimum steady state position may be at a point at which the diverter apparatus or system moves as far forward into the onset current or relative stream flow as possible with a maximum attainable angle of the control lines to the flow direction. It is believed that this optimum position may maximize diversion flow and sweep width to the current or relative onset flow. This optimum position may be visually discernable by the operator using external reference points without the use of instrument(s) or measurement device(s). It is believed that the "lift" forces generated by vertically orientated foil assemblies 20, are in balance with the hydrodynamic drag forces generated by the flow of the current over the system 50, and the tension of the control lines 42 and 44 to maintain the system at this optimum steady state position during use.

Figure 4:
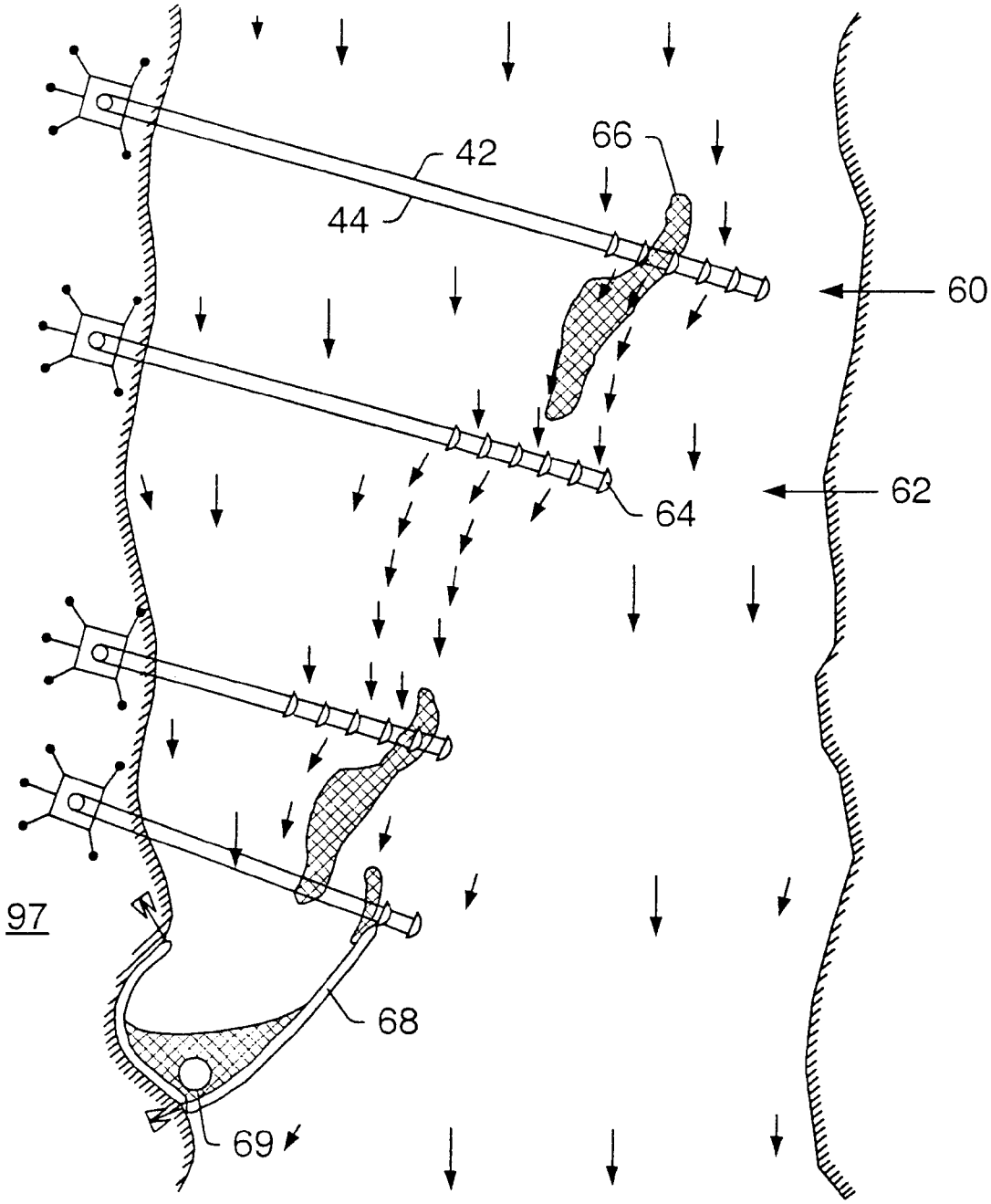
FIG. 4 depicts a plan view of an embodiment of a method for employing several flow-diverter systems.

As used herein, the "sweep length" may generally refer to the distance from the point of deployment to the outer most foil assembly (reference numeral 64 as depicted in FIG. 4). The sweep length may be increase by paying out control lines 42 and 44. In some embodiments, control lines 42 and 44 may be paid out before the foils are flown out into the current and under a strong load. As used herein, the "sweep width" may refer to the width of the surface flow diverted by the system measured perpendicular to the onset flow. In an embodiment, the sweep length and/or sweep width may be increased by connecting one or more additional catamarans 10 to the outermost catamaran of the system.

System 50 may also be deployed from a moving vessel with or without a current present. In an embodiment, if a current is not present, the forward motion of a vessel may facilitate the operation of system 50 and diversion of the surface water behind the moving system 50. In such an embodiment, system 50 may be dynamically positioned by maneuvering the vessel in the water in order to meet an oncoming contaminant or other floating material and divert it as desired into a collection area or device or away from an environmentally sensitive area. System 50 may be deployed off of one side of a vessel or off of both sides as desired. In an embodiment, two systems 50 may be deployed substantially simultaneously, one off of each side of a vessel. In such an embodiment, systems 50 may divert contaminants and other floating materials that pass through and inboard of systems 50 into a more concentrated and narrow row behind the vessel. A trailing skimmer may then recover the concentrated contaminant more efficiently.

Foil assemblies 20 may divert the surface current toward the control line side at an angle approximately that of the angle of attack of foil assemblies 20 to the onset flow. Floating material that passes through and inboard of the foils may be diverted with the redirected surface current downstream of system 50 irrespective of the surface current velocity. A diversion current and localized circulation patterns may be created by interaction of foil assemblies 20 and the current flow. The diversion current and circulation patterns may not only redirect a contaminant or other floating material transverse to the onset flow, but may also concentrate them into a narrow ribbon smaller in width than originally encountered. This concentration effect may facilitate containment and recovery of a contaminant by other devices or equipment, which may be utilized downstream of system 50. The flow diversion effect may be accentuated in shallow water channels (that is, where mean water depth is less than three times foil draft). In these instances, the diversion current may cause a spiral circulation downstream of system 50 in the entire depth of the water column. It is believed that this spiral circulation pattern may supplement the deflection of the surface flow in the desired direction. In contrast, the effectiveness of conventional booms and skimmers may generally be diminished in shallow water due to flow blockage that may cause bow waves which may block a contaminant from reaching the skimmer or increased current under the boom causing contaminant entrainment and loss.

In an embodiment depicted in FIG. 4, two or more flow diverter systems may be used in a cascade arrangement to achieve a larger diversion effect than may be achieved by a single system. For example, a first system 60 may be deployed at a first position with a first sweep length. A second system 62 may be placed downstream from first system 60 at a sweep length less than the sweep length of first system 60. Preferably, the sweep length of second system 62 should be such that the diversion flow of first system 60 is inboard to the outermost foil assembly 64 of second system 62. Each down stream system may subsequently be deployed at a sweep length determined in a similar fashion with respect to the previous upstream system. Such an embodiment may afford more control over contaminants 66 to move contaminants 66 away from a sensitive area or closer to a collection area (defined by booms 68) or device 69. Typically, it may be desirable to divert contaminants 66 close to shore 97 where the currents may slow down to a point that conventional boom and skimmers may be used to contain and/or remove the contaminants from the water. Such an embodiment may also be useful to divert contaminants 66 into a tributary, inlet or man-made collection pocket in the bank for easier recovery.

In addition to diverting flow, system 50 may be configured to tow one or more floating or submerged devices into the current or off to the side of an advancing vessel. Devices to be towed may include, but are not limited to, oil containment deflection booms, sorbent booms, mixing devices, scientific instruments, and rescue equipment. In an embodiment, electrical power lines or device control cables required to operate towed devices may be attached to one or both of the control lines 42 and 44. In an embodiment, system 50 may be used to deploy a boom. In such an embodiment, the "lift" force generated by a single catamaran 10 may be sufficient to deploy and hold a boom out into a current or from a moving vessel or from the shoreline 97. Such an embodiment may enable deployment by one or two individuals. Where the boom may be deployed from shore, such an embodiment may not require the use of a boat thus speeding up response time. Thus, system 50 may replace heavy, expensive and slow to deploy mooring systems, which may be traditionally used for the same purpose. System 50 may also replace the use of heavy and bulky outriggers, which may typically be used to deploy booms off the side of an advancing skimming vessel.

Dispersion of oil or other floating contaminants may be a preferred method of remediation at times. Traditionally, dispersion may be conducted by spraying a chemical dispersant from a low-flying aircraft or from a vessel using nozzles suspended from outriggers. For the dispersant to be effective, it should be applied in the proper concentration and surface mixing conditions. Generally, effective surface mixing may require a 15-knot or stronger wind. In an embodiment where system 50 may be used for dispersing a contaminant, chemical distribution lines may be attached to one or both control lines 42 and 44. For example, in an embodiment depicted in FIG. 7, a chemical distribution system may include a flexible tube 74 that may be attached to upstream control line 42, attachment points 26, rigid cross members 12, or other system members. A chemical reservoir and/or chemical pumping system 75 may be coupled to flexible tube 74. Chemical distribution lines may be attached above or below the water line. Nozzles 76 may be spaced and positioned along distribution tube 74 at T connections to evenly distribute a liquid over the surface of the water or if desired underwater. For example, in an embodiment where oil dispersion on the surface is desired, nozzles 76 may be pointed ahead of hulls 24 to coat the surface oil upstream before mixing starts at the hull bow wave. Floating agitators 72 may be attached to the downstream rigid cross member, attachment point 26 or connection lines 18 as desired. In an embodiment, floating agitators 72 may be attached in such a manner as to keep the hull 24 trim level. This may be accomplished with the use of towing cables 52, as depicted in FIG. 2, if required. System 50 may also be used in lieu of outriggers for dispensing and mixing dispersants. At high speeds, the turbulence generated by system 50 may cause significant mechanical dispersion with or without the use of dispersants chemicals. An advantage of such an embodiment is that it may expand the dispersant technology envelope to include very common low wind and calm conditions.

It may be desirable to treat a contaminant in-situ in some instances. For example, an oil spill may be burned in place to reduce ecological impacts. In such cases, a flow-diverter system as disclosed herein may be used to divert the contaminant to an in-situ treatment location. If the in-situ treatment method includes a chemical reaction, the flow-diverter system may be constructed of or coated with a material that is resistant to degradation by the chemicals used in the treatment process and the contaminants. If the in-situ treatment method involves burning the contaminant, all or portions of the flow-diverter system may be constructed of or coated with fire resistant materials. Additionally, a chemical distribution system as previously described may be used to spray a water mist or foaming chemical agent over the flow diverter system to prevent damage to the system during in-situ burning, to extinguish a fire on the surface of the water, or to divert a burning floating contaminants. In some embodiments, only portions of the flow-diverter system that are likely to be exposed to flames (e.g., portions above water) may be coated with or constructed from fire resistant materials.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. A system for diverting at least a portion of a surface flow of a body of water, the system comprising:

one or more flow-diverter apparatus comprising:

a first foil assembly and a second foil assembly, wherein each foil assembly comprises:

a buoyant member; and a foil coupled to the buoyant member such that at least a portion of the foil extends into the water;

one or more elongated members movably coupling the foil assemblies; and one or more control lines coupled to at least one of the flow-diverter apparatus, wherein an angle of attack of at least one of the foil assemblies is adjustable via at least one of the control lines.

2. A method of diverting a surface of a body of water, the method comprising:

placing a flow-diverter system into the body of water, the system comprising:

one or more flow-diverter apparatus, wherein each flow-diverter apparatus comprises:

a first foil assembly and a second foil assembly, wherein each foil assembly comprises:

a buoyant member; and a foil coupled to the buoyant member such that at least a portion of the foil extends into the water;

one or more elongated members movably coupling the foil assemblies; and one or more control lines coupled to at least one of the flow-diverter apparatus;

feeding out at least one of the control lines until a desired sweep length is attained; and adjusting an angle of attack of the flow-diverter system until a desired angle of attack is attained.

3. An apparatus for diverting at least a portion of a surface flow of water, the apparatus comprising:

a first foil assembly and a second foil assembly, wherein each foil assembly comprises:

a buoyant member; and a foil coupled to the buoyant member such that at least a portion of the foil extends into the water;

one or more elongated members movably coupling the foil assemblies; and wherein at least one of the foil assemblies is configured to divert at least a portion of a surface flow of water without substantially blocking the surface flow.

4. The apparatus of claim 3, wherein the one or more elongated members comprise at least two elongated members.

5. The apparatus of claim 3, wherein the surface flow of water comprises contaminants floating on the water.

6. The apparatus of claim 3, wherein the surface flow of water comprises contaminants floating on the water, and wherein the contaminants comprise hydrocarbons.

7. The apparatus of claim 3, wherein the surface flow of water comprises contaminants floating on the water, and wherein the contaminants comprise oil.

8. The apparatus of claim 3, wherein the apparatus is configured so that a distance between the foils is at least 1.3 times a length of at least one of the buoyant members.

9. The apparatus of claim 3, wherein each foil comprises a leading edge and a trailing edge, and wherein the leading edge and the trailing edge of the foil are shaped to reduce turbulence.

10. The apparatus of claim 3, wherein each foil comprises a leading edge and a trailing edge, and wherein the leading and trailing edges are inclined.

11. The apparatus of claim 3, wherein each foil comprises a first face and a second face, and wherein at least one of the faces of each foil is substantially flat.

12. The apparatus of claim 3, wherein each foil comprises a first face and a second face, and wherein at least one of the faces of each foil is curved.

13. The apparatus of claim 3, wherein at least one of the elongated members comprises a rigid material.

14. The apparatus of claim 3, wherein at least one of the elongated members comprises at least one spacer configured to restrict the motion of the foil assemblies such that a minimum distance is maintained between the foil assemblies.

15. The apparatus of claim 3, wherein the foil assemblies further comprise a spacer configured to restrict the motion of foil assemblies such that a minimum distance is maintained between the foil assemblies.

16. The apparatus of claim 3, wherein each foil assembly further comprises one or more movable elongated members movably coupling at least one of the elongated members to the foil assembly.

17. The apparatus of claim 3, wherein at least one of the elongated members is configured to keep the foil assemblies substantially parallel during use.

18. The apparatus of claim 3, further comprising one or more submerged elongated members, wherein at least one of the submerged elongated members is movably coupled to the foil assemblies.

19. The apparatus of claim 3, further comprising one or more submerged elongated members, wherein each foil assembly further comprises one or more movable elongated members movably coupling at least one of the submerged elongated members to the foil assembly.

20. The apparatus of claim 3, further comprising one or more submerged elongated members, wherein at least one of the submerged elongated members comprises a rigid material.

21. The apparatus of claim 3, further comprising one or more submerged elongated members, wherein at least one of the submerged elongated members comprises a cable.

22. The apparatus of claim 3, further comprising one or more submerged elongated members and one or more covers on at least one of the submerged elongated members, wherein at least one of the covers is configured to reduce drag.

23. The apparatus of claim 3, wherein each buoyant member comprises a first end and a second end, and wherein the first end and the second end of each buoyant member are shaped to reduce turbulence.

24. The apparatus of claim 3, wherein each buoyant member comprises a first end and a second end, and wherein the first end and the second end of each buoyant member are inclined.

25. The apparatus of claim 3, wherein at least one of the buoyant members comprises a slot for receiving the coupled foil, and wherein the coupled foil is retained within such buoyant member at a desired draft by a retaining device.

26. The apparatus of claim 3, wherein a length of each buoyant member is greater than a length of at least one of the foils.

27. The apparatus of claim 3, wherein a length of each buoyant member is at least 2 times a length of at least one of the foils.

28. The apparatus of claim 3, wherein each buoyant member is symmetrical fore and aft.

29. The apparatus of claim 3, wherein each foil is symmetrical fore and aft.

30. The apparatus of claim 3, wherein each foil assembly is symmetrical fore and aft.

31. The apparatus of claim 3, further comprising one or more impellers coupled to the apparatus, wherein at least one of the impellers is configured to agitate the surface of the water.

32. The apparatus of claim 3, further comprising one or more mixing devices coupled to the apparatus, wherein at least one of the mixing devices is configured to agitate the surface of the water.

33. The apparatus of claim 3, further comprising one or more chemical feed lines coupled to the apparatus, wherein at least one of the chemical feed lines is configured to dispense a chemical to the water.

34. The apparatus of claim 3, further comprising one or more chemical feed lines coupled to the apparatus, wherein at least one of the chemical feed lines is configured to dispense a chemical over the apparatus.

35. The apparatus of claim 3, wherein the foil assemblies are coated to resist oil intrusion, chemical degradation, and denting.

36. The apparatus of claim 3, wherein each buoyant member comprises a fire resistant material.

37. The apparatus of claim 3, wherein each elongated member comprises a fire resistant material.

38. The apparatus of claim 3, comprising one or more fire resistant materials.

39. The apparatus of claim 3, further comprising at least one chemical feed line and at least one chemical distribution nozzle, wherein at least one of the chemical feed lines comprises a fire resistant material and wherein at least one of the chemical distribution nozzles comprises a fire resistant material.

40. The apparatus of claim 3, further comprising one or more attachment points, wherein each attachment point comprises a fire resistant material.

41. The apparatus of claim 3, further comprising ballast, wherein the ballast is coupled to at least one of the foil assemblies to provide heel stability.

42. The apparatus of claim 3, further comprising ballast, wherein the ballast is internal to at least one of the foil assemblies to provide heel stability.

43. The apparatus of claim 3, wherein a distance between the foil assemblies is adjustable.

44. The apparatus of claim 3, further comprising one or more foil extensions, wherein at least one of the foil extensions is configured to be coupled to a bottom of at least one of the foils.

45. The apparatus of claim 3, wherein at least one of the foils is configured to have an adjustable draft.

46. The apparatus of claim 3, further comprising one or more towing connectors coupled to the apparatus, wherein at least one of the towing connectors is configured to couple equipment to be towed to the apparatus, and wherein at least one of the towing connectors is configured to vertically distribute forces exerted on the apparatus during use.

47. The apparatus of claim 3, further comprising one or more devices configured to vertically distribute a force exerted by a control line on at least one of the foil assemblies.

48. The apparatus of claim 3, further comprising one or more cables configured to couple one or more control lines to at least one of the foil assemblies, wherein at least one of the cables is configured to vertically distribute a force exerted by at least one of the control lines on at least one of the foil assemblies.

49. The apparatus of claim 3, further comprising one or more cables configured to couple one or more control lines to at least one of the foil assemblies, wherein at least one of the cables is configured to have an adjustable length.

50. The apparatus of claim 3, further comprising one or more cables configured to couple one or more control lines to at least one of the foil assemblies, and further comprising one or more covers on at least one of the cables, wherein at least one of the covers is configured to reduce drag.

51. The apparatus of claim 3, further comprising one or more towing connectors configured to couple equipment to be towed to at least one of the foil assemblies.

52. The apparatus of claim 3, further comprising one or more towing connectors configured to couple equipment to be towed to at least one of the foil assemblies, wherein at least one of the towing connectors is configured to vertically distribute forces exerted on at least one of the foil assemblies during use.

53. The apparatus of claim 3, further comprising one or more connectors, wherein at least one of the connectors is configured to allow at least one of the foil assemblies to be coupled to one or more additional foil assemblies.

54. An apparatus for diverting at least a portion of a surface flow of water, the apparatus comprising:

a first foil assembly and a second foil assembly, wherein each foil assembly comprises:

a buoyant member; and a foil coupled to the buoyant member such that at least a portion of the foil extends into the water;

one or more elongated members movably coupling the foil assemblies;

wherein at least one of the foil assemblies is configured to divert at least a portion of a surface flow of water without substantially blocking the surface flow; and wherein the apparatus is configured so that a distance between the foils is at least 1.3 times a length of at least one of the buoyant members.

55. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

wherein at least one of the foil assemblies is configured to divert at least a portion of a surface flow of water without substantially blocking the surface flow; and wherein each foil comprises a first face and a second face, and wherein at least one of the faces of each foil is substantially flat.

56. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

one or more submerged elongated members; and wherein at least one of the foil assemblies is configured to divert at least a portion of a surface flow of water without substantially blocking the surface flow;

wherein the at least one submerged elongated member comprises a cable.

57. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

one or more submerged elongated members;

one or more covers on at least one of the submerged elongated members, wherein at least one of the covers is configured to reduce drag; and wherein at least one of the foil assemblies is configured to divert at least a portion of a surface flow of water without substantially blocking the surface flow.

58. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

one or more impellers coupled to the apparatus, wherein at least one of the impellers is configured to agitate the surface of the water; and wherein at least one of the foil assemblies is configured to divert at least a portion of a surface flow of water without substantially blocking the surface flow.

59. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

one or more mixing devices coupled to the apparatus, wherein at least one of the mixing devices is configured to agitate the surface of the water; and wherein at least one of the foil assemblies is configured to divert at least a portion of a surface flow of water without substantially blocking the surface flow.

60. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

one or more chemical feed lines coupled to the apparatus; and wherein at least one of the foil assemblies is configured to divert at least a portion of a surface flow of water without substantially blocking the surface flow.

61. The apparatus of claim 60, wherein at least one of the chemical feed lines is configured to dispense a chemical to the water.

62. The apparatus of claim 60, wherein at least one of the chemical feed lines is configured to dispense a chemical over the apparatus.

63. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

one or more chemical feed lines and one or more chemical distribution nozzles, wherein at least one of the chemical feed lines and at least one of the chemical distribution nozzles comprise a fire resistant material; and wherein at least one of the foil assemblies is configured to divert at least a portion of a surface flow of water without substantially blocking the surface flow.

64. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

a foil extension, wherein the foil extension is configured to be coupled to a bottom of at least one such foil; and wherein at least one of the foil assemblies is configured to divert at least a portion of a surface flow of water without substantially blocking the surface flow.

65. An apparatus for diverting at least a portion of a surface flow of water, the apparatus comprising:

a first foil assembly and a second foil assembly, wherein at least one of the foil assemblies comprises:

a buoyant member; and a foil coupled to the buoyant member such that at least a portion of the foil extends into the water;

one or more elongated members movably coupling the foil assemblies;

wherein at least one of the foil assemblies is configured to divert at least a portion of a surface flow of water without substantially blocking the surface flow; and wherein at least one such foil is configured to have an adjustable draft.

66. An apparatus for diverting at least a portion of a surface flow of water, the apparatus comprising:

a first foil assembly and a second foil assembly, wherein at least one of the foil assemblies comprise:

a buoyant member; and a foil coupled to the buoyant member such that at least a portion of the foil extends into the water;

one or more elongated members movably coupling the foil assemblies;

one or more cables configured to couple one or more control lines to at least one of the foil assemblies;

one or more covers on at least one of the cables, wherein at least one of the covers is configured to reduce drag; and wherein at least one of the foil assemblies is configured to divert at least a portion of a surface flow of water without substantially blocking the surface flow.

* * * * *